US005695248A

United States Patent [19]

Bell

[11] Patent Number: 5,695,248

[45] Date of Patent: Dec. 9, 1997

[54] RETROFIT ADJUSTABLE SEAT

[76] Inventor: Dale A. Bell, 1245 Hormell Rd., Wilmington, Ohio 45177

[21] Appl. No.: 676,855

[22] Filed: Jul. 3, 1996

[51] Int. Cl.[6] ..... A47C 1/02

[52] U.S. Cl. ..... 297/344.17; 297/256.11; 297/252

[58] Field of Search ..... 297/106, 252, 297/256.11, 344.17, 344.15, 344.12, DIG. 4

[56] References Cited

U.S. PATENT DOCUMENTS

| | | | |
|---|---|---|---|
| 278,818 | 6/1883 | Poolman et al. . | |
| 722,166 | 3/1903 | Taft . | |
| 1,088,419 | 4/1914 | Heyer . | |
| 2,521,281 | 9/1950 | Brousseau | 297/256.11 X |
| 2,678,087 | 5/1954 | McKinley | 155/91 |
| 2,689,601 | 9/1954 | Fredenburgh | 297/252 |
| 2,821,242 | 1/1958 | Manegold | 155/91 |
| 2,828,804 | 4/1958 | Schwinn | 297/256.11 |
| 2,935,122 | 5/1960 | Miller | 297/256.11 |
| 2,993,675 | 7/1961 | Tatter | 297/252 X |
| 3,915,494 | 10/1975 | Somerset | 297/339 |
| 4,232,901 | 11/1980 | Harrington et al. | 297/439 |
| 4,581,778 | 4/1986 | Pontoppidan | 4/251 |
| 4,685,731 | 8/1987 | Migut | 297/347 |
| 4,850,645 | 7/1989 | Crockett | 297/330 |
| 4,993,736 | 2/1991 | Garman et al. | 280/304.1 |
| 5,112,076 | 5/1992 | Wilson | 280/657 |

FOREIGN PATENT DOCUMENTS

| | | | |
|---|---|---|---|
| 877095 | 8/1971 | Canada | 297/344.15 |
| 6284939 | 10/1994 | Japan | 297/344.17 |

*Primary Examiner*—Laurie K. Cranmer
*Attorney, Agent, or Firm*—R. William Graham

[57] ABSTRACT

A retrofit adjustable seat for connection to a conventional wheelchair having a frame, wheels, a wheelchair seat and back operably connected thereto, comprises a base with releasable connector for connnecting the base to the frame of the wheelchair, a retrofit seat, and an elevator operably connecting the base and the retrofit seat for adjustably elevating the retrofit seat to a selectable height.

6 Claims, 4 Drawing Sheets

RETROFIT ADJUSTABLE SEAT

BACKGROUND OF INVENTION

This invention concerns improvements in or relating to a retrofit adjustable seat primarily for use on a wheelchair and like apparatus for raising and lowering a seat of a wheelchair.

Wheelchairs are known to contain lifting devices to adjust the height of a seat of a wheelchair to enable a seated person to be raised or lowered. However, these wheelchairs are of limited use in that the lifting device is permanently fixed to the wheelchair and encumber the same.

Thus, while current wheelchairs do enable disabled people to adjust the seat height, there is no simple way to change a conventional wheelchair to one with such capabilities on an as needed basis. It is desirable to create a device for adjusting seat height that can easily be connected or removed from a conventional wheelchair as desired.

BRIEF SUMMARY OF INVENTION

It is an object to improve wheelchairs.

It is another object to provide a device which serves as a height adjustable seat for a conventional wheelchair and which is removable in nature.

Accordingly, the invention is directed to a retrofit adjustable seat for connection to a conventional wheelchair having a frame, wheels, a wheelchair seat and a back which are operably connected thereto, the retrofit adjustable seat comprising a base having means for releasably connecting to the frame of the wheelchair, a retrofit seat, and means connecting the base to the retrofit seat for adjustably elevating the retrofit seat to a selectable height with regard to the base. The elevating means includes a plurality of interconnected movable members, which operate together to raise or lower the retrofit seat.

DETAILED DESCRIPTION OF THE INVENTION

Figure 1:
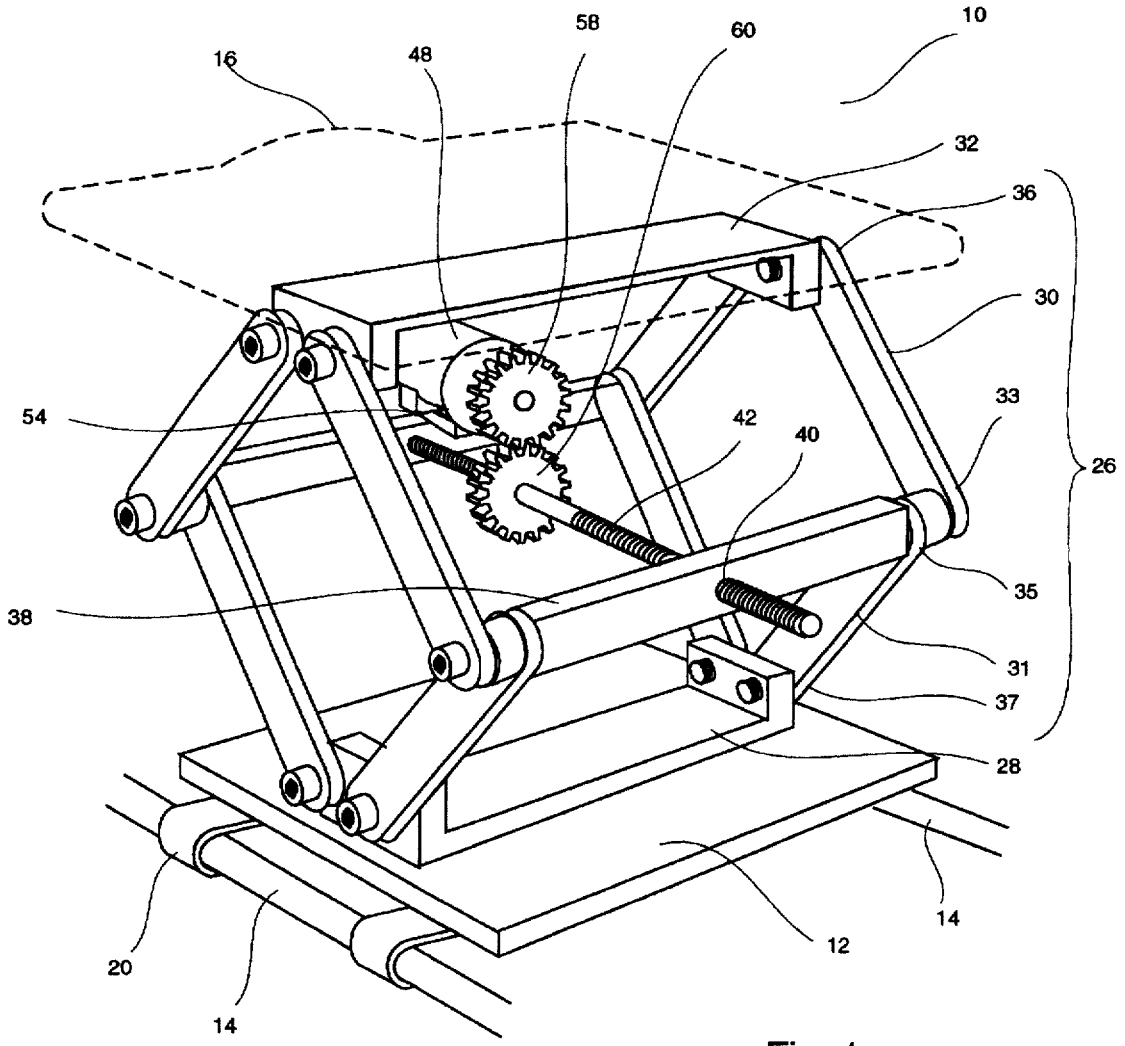
FIG. 1 is a perspective view of the retrofit adjustable seat of the present invention.
Figure 2:
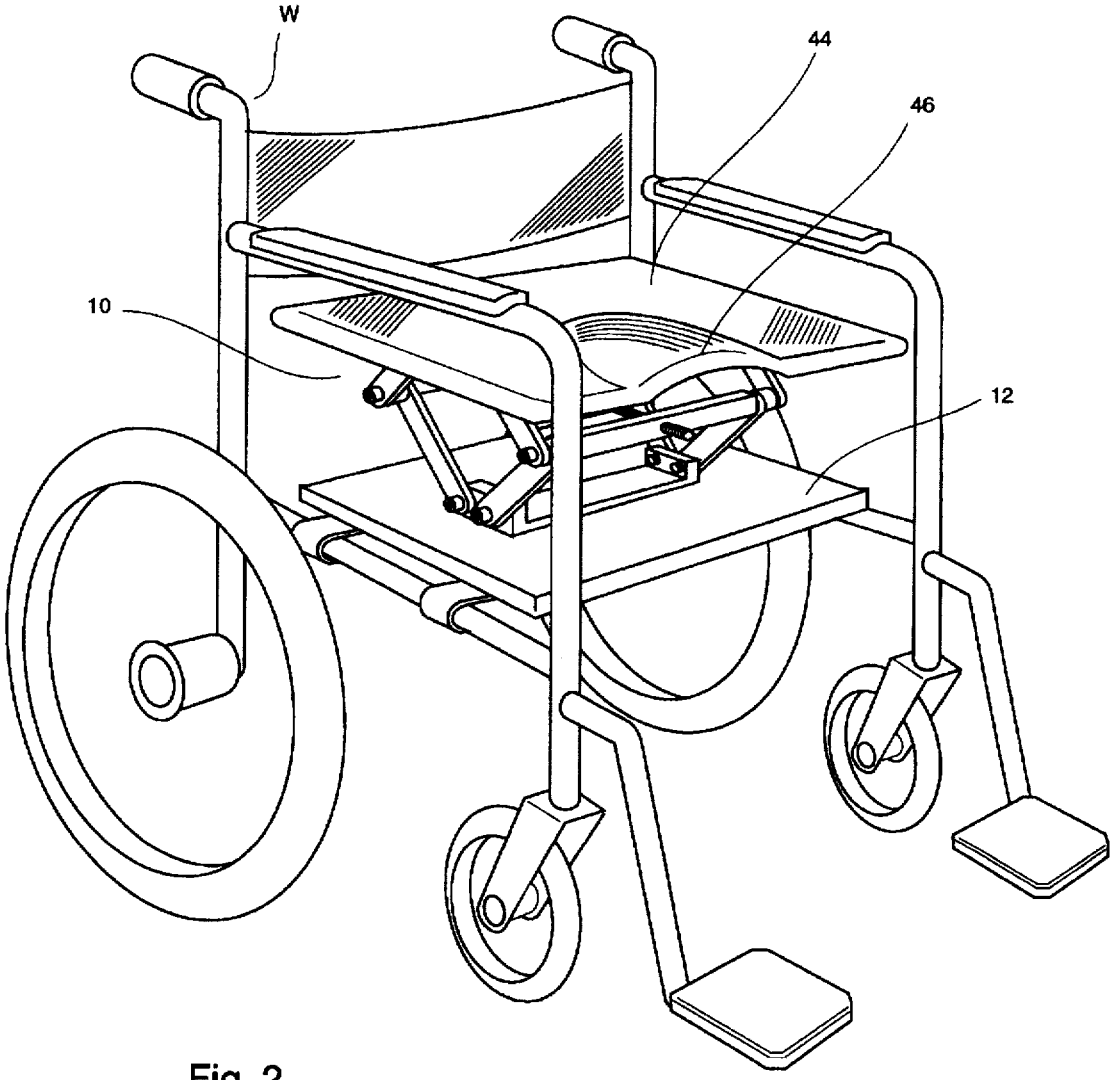
FIG. 2 is a perspective view of a wheelchair with the retrofit adjustable seat of the present invention.

Referring to the drawings, the retrofit adjustable seat 10 includes a base 12 which is connected to the side frame member 14 of a conventional wheelchair W through use of brackets 16 which are fixably slidably connected to the base 12. The base 12 may be formed of any resilient and strong material, preferably a light weight plastic, providing ease of portability along with strength.

Figure 3:
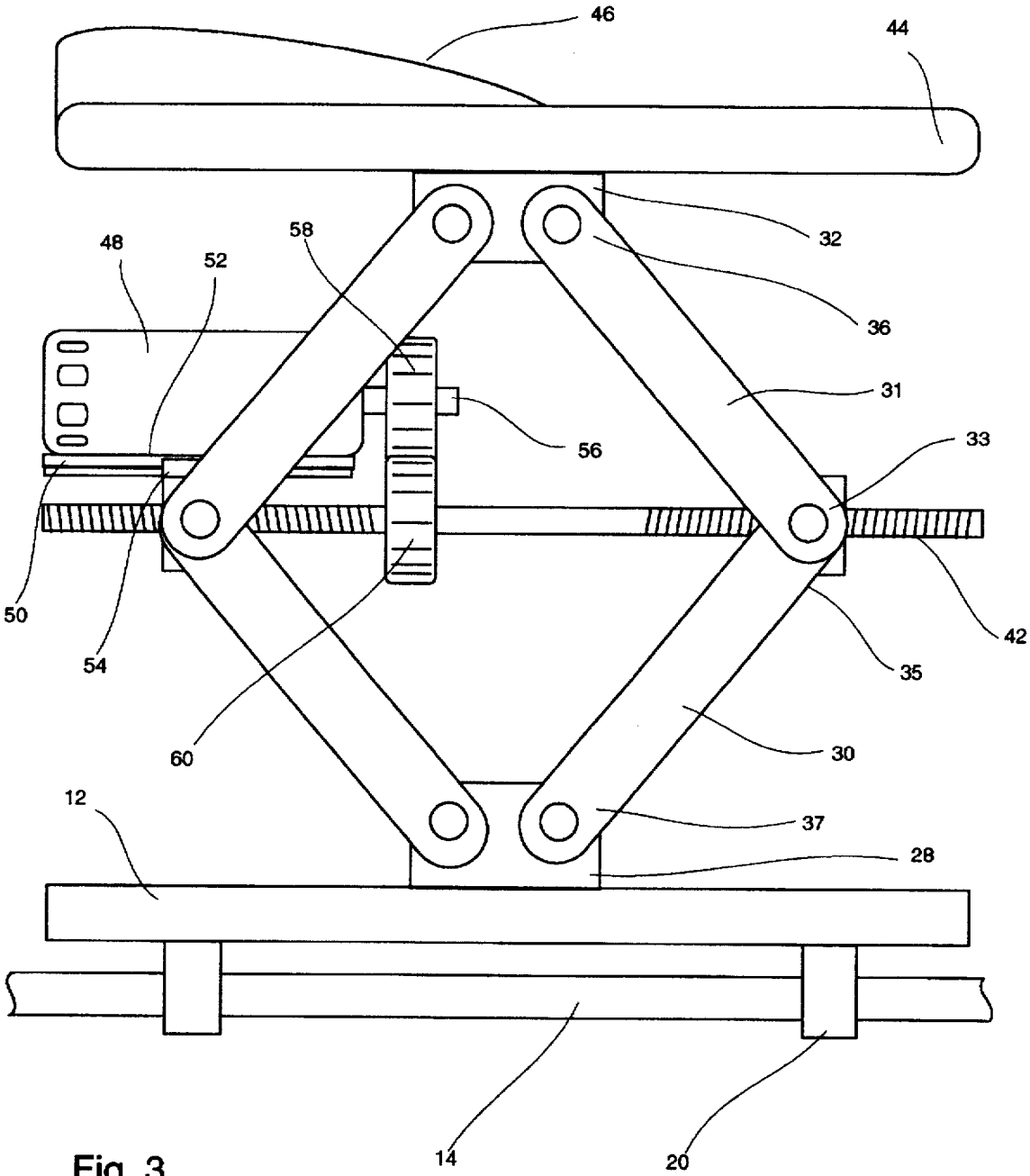
FIG. 3 is a side view of the retrofit adjustable seat of the present invention.
Figure 4:
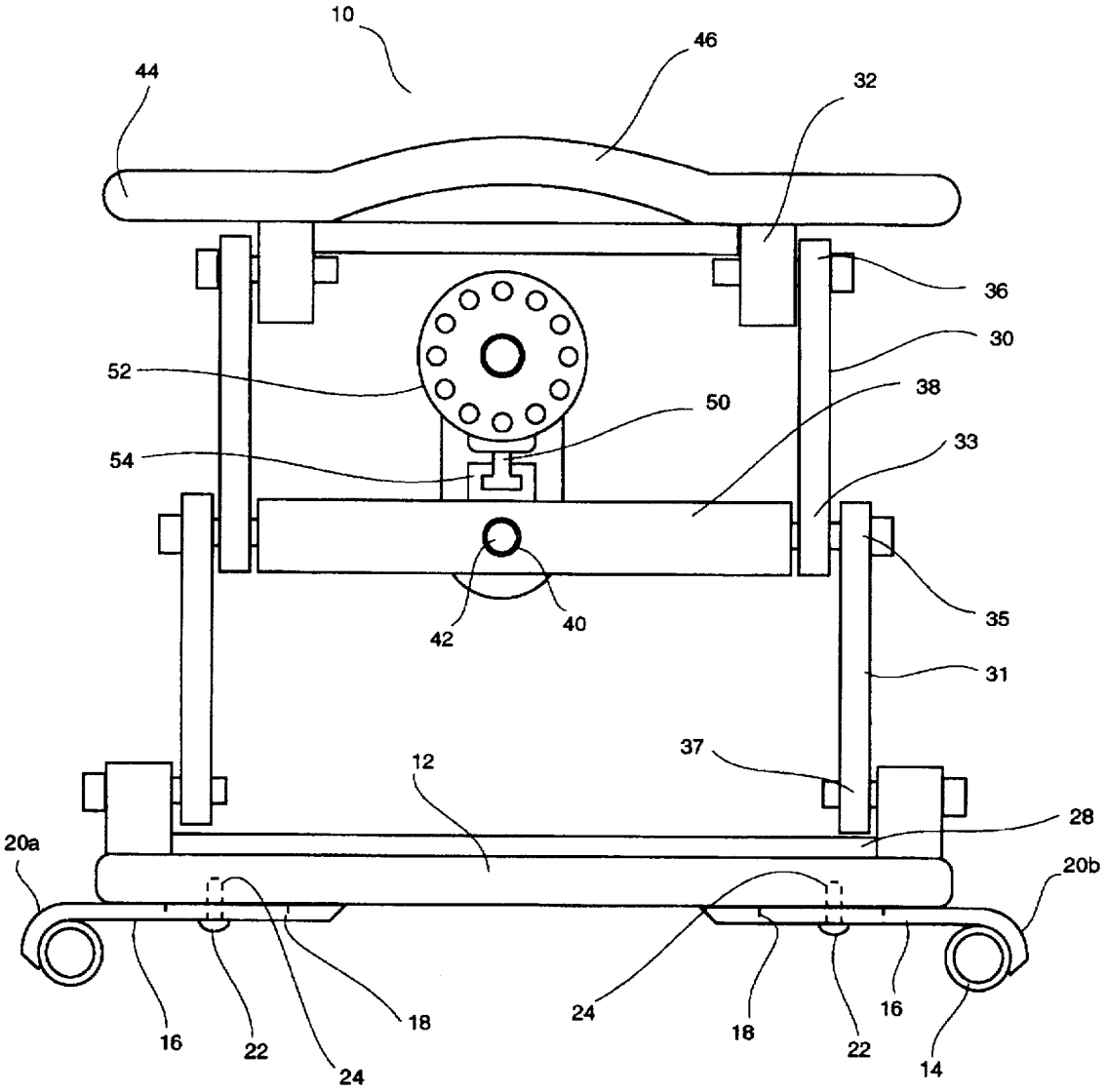
FIG. 4 is a front view of retrofit adjustable seat of the present invention.

As seen in FIG. 3, the brackets 16 are generally planar and elongated having an open surface 18 therein and a terminal end 20 which is slightly arcuate. Screws 22 are provided of a size such that the threads thereof are less in diameter than the open surfaces 18 and are received within threaded open surfaces 24 of the base 12 to enable connection of the brackets 16 to the base 12. When the screws 22 are loosened, the brackets 16 may be lengthwise positioned and then fixed in place by tightening screws 22 to the base 12.

When the wheelchair W is opened the wheelchair side frame members 14 typically opens to a first predetermined spacing. The wheelchair side members 14 open to a second maximum spacing when a person sits on the wheelchair W. The wheelchair side members 14 return to the first spacing when the person gets off the wheelchair W.

The brackets 16 are positioned such that a distance between the ends **20*a* and 20*b* are slightly greater than the second distance to accommodate the side members 14 in their maximum spaced relation. The arcuate terminal ends 20 are in a fixed contact with the wheelchair side members 14 to hold the retrofit adjustable seat 10 in place until the person gets off of the wheelchair W, at which time the wheelchair side members 14 return to their first spaced relation to permit removal of the retrofit adjustable seat 10. Also, the screws 22** can be loosened to aid the removal of the retrofit adjustable seat.

Means 26 for elevating are provided and include a base support member 28 connected to the base 12, side support members 30 and 31, and a top support member 32. An end 33 of side support member 30 is hingedly connected to an end 35 of side support member 31. An end 36 of side support member 31 is hingedly connected to top support member 32 and an end 37 of side support member 30 is hingedly connected to base support member 28. Interconnecting members 38 are also provided, which interconnect ends 33 and 35 and have a threaded open surface 40. A threaded bar 42 has opposite threaded ends and threads to open surfaces 40.

The elevating means 26 further includes a motor 48 which is slidably connected to one of the interconnecting members 38 by way of a track member 50 extending from a motor housing 52 and a track guide 54 connected to one of the interconnecting members 38 to slidably receive the track member 50 therein. The motor 48 has a drive shaft 56 axially extending therefrom and has a gear head 58 rigidly connected to the drive shaft 56. A gear 60 is fixably disposed about the threaded bar 42 and mates with gear head 58 in a manner to permit rotation with respect to one another while stop 61 limits translational movement such that the gears 58 and 60 do not become disengaged. The motor 48 can be powered by a battery (not shown) or other energy source, for example, which is connected to the base 12.

A retrofit seat 44 is connected to the top support member 32. The retrofit seat 44 preferably includes a bottom made of rigid material to support an individual when seated thereon as well as a soft cushion disposed on top of the bottom. The retrofit seat 44 may be formed in any variety of configurations. For example, the retrofit seat 44 may be formed with a central raised edge portion 46 the purpose of which is to aid in leg comfort and support to the user as well as provide additional space therebeneath for accommodating the motor 48.

A control 64 operably connects to the motor 48 and battery 62 and can be disposed adjacently the retrofit seat 44 or on the wheelchair W. The control 64 may be a hand operated switch or a joy stick mounted on a cord, for example, wherein moving the switch or joy stick one direction raises the retrofit seat 44 and moving the switch or joy stick in another direction lowers the seat.

A flexible expandable side cover 64 can be optionally included to cover the retrofit seat 10, elevating means 26 and base 12. The cover 64 can be of any suitable cloth or synthetic material.

While the present invention has been set forth above in a preferred embodiment, it is contemplated that other modifications, improvements and derivations will be readily apparent to those skilled in the art. Accordingly, the appended claims hereto should be accorded the full scope of protection of any such modifications, improvements and derivations.

What is claimed is:

1. A wheelchair having a retrofit adjustable seat, comprising:

a frame having a pair of laterally disposed side members, wherein each said side member has a seat supporting bar and a wheel supporting hub;

a wheel operably connected to each said hub;

a seat interconnecting said seat supporting bars; and a retrofit seat having a base with laterally extending means for releasably connecting said base to said seat supporting bars and means operably connecting said base and said retrofit seat for adjustably elevating said retrofit seat to a selectable height.

2. The wheelchair having a retrofit adjustable seat according to claim 1, wherein said releasably connecting means includes at least two brackets fixably slidably connected to said base.

3. The wheelchair having a retrofit adjustable seat according to claim 2, wherein each of said brackets has an open surface and an arcuate end configured to connect to the wheelchair frame.

4. The wheelchair having a retrofit adjustable seat according to claim 3, which further includes a control operatively connected to said motor for controlling operation of said motor.

5. The wheelchair having a retrofit adjustable seat according to claim 1, wherein said elevating means includes movably interconnected members wherein at least one of said members has a threaded open surface, a threaded bar threadably connected to said threaded open surface, a powered motor slidably connected to one of said members and which is operably connected to the threaded such that powering said motor causes turning of said threaded bar and movement of members in a manner to elevate and lower said retrofit seat.

6. The wheelchair having a retrofit adjustable seat according to claim 5, wherein said powered motor is slidably connected to said interconnected member.

* * * * *